United States Patent [19]

Goncharov

[11] 4,247,392

[45] Jan. 27, 1981

[54] SCREEN FOR VIBRATING CENTRIFUGAL SEPARATION MACHINES

[76] Inventor: Evgeny S. Goncharov, ulitsa Lomonosova, 30/1, kv. 46, Kiev, U.S.S.R.

[21] Appl. No.: 52,360

[22] Filed: Jun. 27, 1979

[51] Int. Cl.[3] ..... B04B 7/18

[52] U.S. Cl. ..... 209/301; 210/380.1

[58] Field of Search ..... 209/301–306; 210/360 R, 380 R, 380 L, 380 H, 384

[56] References Cited

U.S. PATENT DOCUMENTS

| | | | |
|---|---|---|---|
| 1,961,226 | 6/1934 | Keatley et al. | 210/360 R X |
| 2,802,574 | 8/1957 | Schweppe | 210/369 |

FOREIGN PATENT DOCUMENTS

| | | | |
|---|---|---|---|
| 331860 | 11/1903 | France | 209/302 |

*Primary Examiner*—William A. Cuchlinski, Jr.

*Attorney, Agent, or Firm*—Burgess, Ryan and Wayne

[57] ABSTRACT

A screen for vibrating centrifugal separation machines, which screen is made in the form of a solid of revolution and comprises a sifting part and a non-sifting part. The generatrix of the sifting part has a stepped shape, each step forming a solid of revolution in the form of a hollow conic frustum whose major base faces opposite to the movement of the layer of the loose material under treatment. This construction substantially increases the separating properties of the screen in using it in various vibrating centrifugal separation machines.

3 Claims, 4 Drawing Figures

SCREEN FOR VIBRATING CENTRIFUGAL SEPARATION MACHINES

The present invention relates to devices for separating various loose materials and has particular reference to screens for vibrating centrifugal separation machines.

It can be used for separating seeds and various grain materials in agriculture and the food industry and for separating various loose mineral materials in the mining, chemical and other industries.

Known in the art are screens for vibrating centrifugal separation machines, which screens are designed for cleaning and/or grading loose materials and are made in the form of a solid of revolution (see, for example, USSR Inventor's Certificate No. 544476, class B 07 B 1/48). Such a screen has the form of a hollow cylinder whose wall has a sifting part and a non-sifting part. The generatrix of the surface of the sifting part of the screen is a straight line and, therefore, said surface is plain. Such a screen is mounted on the rotor of a vibrating centrifugal separation machine. For convenient mounting, the screen is divided into several parts along the generatrix of its surface.

The screen is given a rotary motion and a reciprocating motion simultaneously, the material to be separated being fed onto the inner surface. Due to the rotary motion of the screen and the resultant centrifugal forces, the material under treatment forms an annular layer on the screen surface. Due to the reciprocating motion of the screen and the resultant intertia forces, the annular layer of the material moves on the screen surface along the axis of screen rotation. As a result, the smaller particles are sifted through the screen apertures to form a separate fraction.

It is known that the nature of the movement of loose material on the screen surface substantially influences the working capacity of the screen. In this connection, the effectiveness of the separation process is determined primarily by two main factors, viz.: the rate of sifting of small particles through the screen apertures and the rate of movement of said particles towards the screen surface from inside the layer of the loose material lodging on the screen surface. The rate of sifting of the material particles through the screen apertures depends, in particular, on the velocity of their relative movement on the screen surface. The rate of movement of the particles towards the screen surface from inside the material layer depends mainly on the looseness of the material layer (i.e. relative movement of the particles).

The velocity of the movement of loose material on the screen surface depends, in particular, on the frequency of its vibrations which also cause loosening of the material layer. When the frequency of screen vibration exceeds a certain limit, the rate of sifting of small particles decreases due to increase in the velocity of their relative movement which adversely affects the possibility of the particles getting into the screen apertures. At the same time the material layer becomes more loosened which promotes a greater rate of movement of small particles from inside the material layer towards the screen surface. If there were no decrease in the rate of sifting under these conditions, the working capacity of the screen would increase with increasing frequency or amplitude of screen vibration to a still greater extent than it is achieved with the screens known in the prior art.

Therefore, the tendency to increase the working capacity of the prior-art screens by intensifying the mode of their vibration leads chiefly to undesirable increase in the velocity of movement of the material particles with consequent decrease in the rate of their sifting.

The numerous attempts to boost the loosening of the grain layer at the screen vibration frequency favourable for sifting small particles by fitting pegs of various height, ribs, bars, etc. on the surface of the screen sifting part have failed to give a substantial effect. Moreover, they have complicated the construction of the screens and reduced the number of screen apertures.

It is the primary object of the present invention to improve screen separating properties.

It is a further object of the present invention to increase screen working capacity.

It is a still further object of the present invention to increase screen longevity.

It is a still further object of the present invention to reduce specific use of screen making material referred to screen performance in separating loose materials.

It is a still further object of the present invention to reduce specific power consumption in screening loose materials.

These and other objects are achieved by providing a screen for vibrating centrifugal separation machines, which screen is made in the form of a solid of revolution and has a sifting part designed for sifting loose material and a non-sifting part serving for attaching the sieve to the mounting elements of the machine.

According to the invention, the generatrix of the surface of the sifting part of the screen is of stepped form. The resultant shape of the screen surface makes it possible to substantially augment the loosening of the layer of the material under treatment, thereby increasing the rate of movement of small particles from inside the layer towards the screen surface. A further advantage of said shape of the screen surface is that it adds to the rigidity of the screen wall.

It is desirable that each step of the generatrix be shaped so that its revolution produces a hollow frustum of a cone whose major base faces opposite to the movement of the material under treatment. This constructional arrangement provides for increasing the rate of sifting the particles of loose material through the screen apertures.

Now the invention will be described in detail with reference to the accompanying drawings in which.

Figure 1:
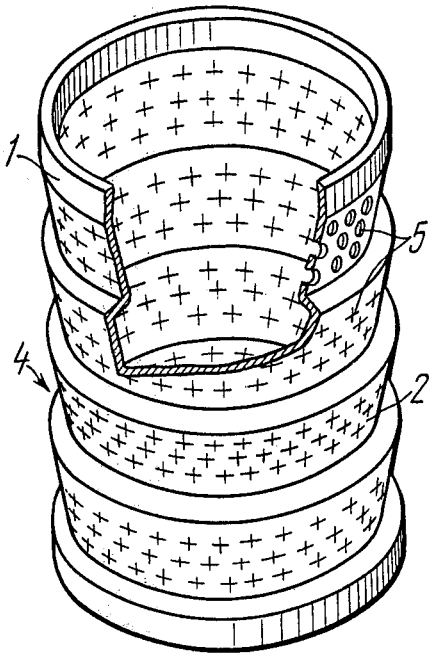
FIG. 1 is a general view of the screen constructed according to the present invention for use in vibrating centrifugal separation machines.

The screen for vibrating centrifugal separation machines which constitutes the present invention comprises a non-sifting part 1 (FIG. 1) designed for attaching the screen to the mounting elements of the machine involved and a sifting part 2 designed for sifting loose material. The generatrix 3 (FIG. 2) of the surface of the screen sifting part 2 (FIG. 1) has a stepped shape. Each step 4 (FIG. 3) of the generatrix 3 (FIG. 2) has pitch "l" and height "h". The portions of the screen surface corresponding to each step 4 (FIG. 3) of the generatrix 3 (FIG. 2) have smooth junctions curved in a cross section to the radius "r". The pitch "l" is several times greater than the height "h".

The shape and size of holes 5 (FIG. 1) in the wall of the screen sifting part 2 depend on the screen application. The holes 5 may be round, rectangular, square, triangular, oval, etc.

The non-sifting part 1 and the sifting part 2 can be made of identical or different materials, for example, of steel, or of steel and plastics, etc.

For use in a vibrating centrifugal separation machine, the screen is attached to the mounting elements 6 (FIG. 2) of the machine rotor by any method known in the art and is simultaneously rotated and reciprocated by the method appropriate to the design of the machine involved.

For example, in a machine with a vertical rotor the screen is simultaneously rotated about its axis and reciprocated along the axis. The loose material is fed at the screen top onto the screen inner surface. Coming into contact with the screen surface, the material assumes a rotary motion which gives rise to centrifugal forces and the latter cause the material to form an annular layer 7 (FIG. 2) on the screen surface. The oscillating movement of the screen sets up intertia forces which impart pulsating relative velocity to the material layer 7 due to which the material moves downwards on the screen surface at the average velocity $V_1$.

Moving from step to step, the material layer 7 becomes substantially deformed, which augments the loosening of the material and sharply increases the rate of movement of small particles from inside the layer 7 towards the surface of the screen. Then said particles are sifted through the holes 5 and collected in the machine to produce a separate fraction. This way of loosening the material layer substantially increases the working capacity of the screen.

The centrifugal forces of the material layer 7 exert a comparatively heavy radial pressure onto the screen wall. However, the stepped construction of the screen wall substantially increases the radial rigidity thereof and thereby considerably increases the screen strength and longevity.

For convenience in use, the screen constituting the present invention can be divided into several parts along the generatrix 3 (FIG. 2) in such a manner that putting said parts together will form a surface of revolution.

The efficiency of screen performance is largely dependent on the shape of the steps 4 (FIG. 3) and the orientation thereof in relation to the direction of movement of the material layer 7. The steps 4 must be shaped and orientated so that the major base of the hollow conic frustum produced by their revolution faces opposite to the movement of the material layer 7. This condition provides for the required reduction of the relative velocity of the particles in direct contact with the screen surface when increase takes place, for example, in the frequency of screen vibration, due to which small particles have more possibility of getting into the holes and thereby the rate of their sifting is increased substantially.

Figure 3:
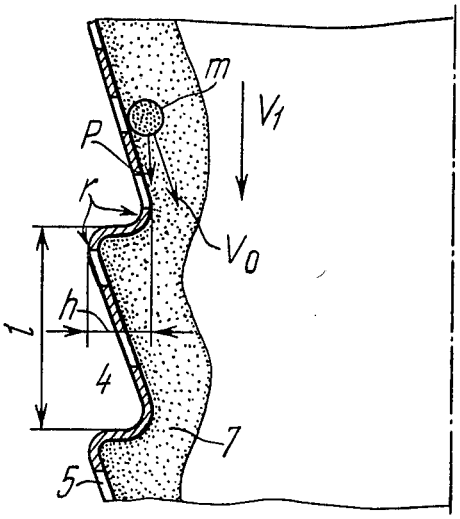
FIG. 3 is a fragmentary longitudinal sectional view of the perforated portion of the screen constituting the present invention and of the layer of loose material on the surface thereof.
Figure 4:
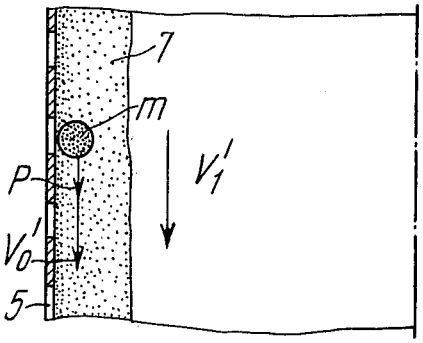
FIG. 4 is a fragmentary longitudinal sectional view of the perforated portion of a prior-art screen and of the layer of loose material on the surface thereof.

This is attributed to the fact that when a particle "m" (FIG. 3) of loose material moves specifically under the action of its weight "P" directly on the screen surface, it travels not only along the screen axis, but also some distance towards the axis. During such a movement the particle meets additional resistance from the centrifugal inertia force component directed along the step, due to which the relative velocity $V_o$ of the particle becomes considerably less than the average velocity $V_1$ of the material layer. Under these conditions the particle "m" gets into the holes and passes therethrough much more frequently than in the case of the prior-art screen, all the rest of the conditions being equal. In the prior-art screen made, for example, in the form of a vertical hollow cylinder, the particle "m" (FIG. 4) moves on the screen surface along the screen axis specifically under the action of its weight "P". In this screen the centrifugal force is normal to the generatrix of its surface. Therefore, with all the rest of the conditions equal, the particle "m" moves in the prior-art screen at a relative velocity $V_o'$ which is greater than $V_o$ (FIG. 3). The velocity $V_o'$ (FIG. 4) of the particle "m" differs insignificantly from the average velocity $V_1'$ of the material layer which adversely affects both the loosening of the material layer and the rate of particle sifting.

With the generatrix of the surface of the screen sifting part 2 (FIG. 1) comprising the steps 4 (FIG. 3) according to the invention, the velocity of the particles on the surface of the layer 7 (FIG. 3) can be several times greater than the velocity of the particles "m" on the screen surface inasmuch as the upper portions of the layer 7 move over the projections of the steps 4 and the latter restrict their motion to a smaller extent. This condition boosts the loosening of the layer 7 and promotes further increase in the working capacity of the screen.

Figure 2:
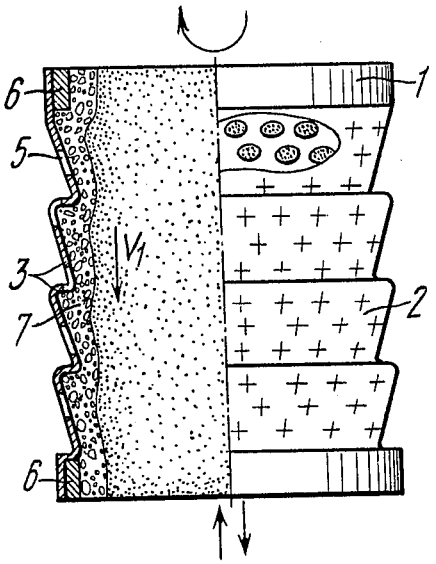
FIG. 2 is a longitudinal sectional view of the screen constructed according to the present invention for use in vibrating centrifugal separation machines.

For convenience in manufacture and standardization of the screen constituting the present invention, it is desirable that the parameters "h" and "l" be the same for all the steps 4 (FIG. 3) of the generatrix 3 (FIG. 2).

The screen for vibrating centrifugal separation machines which constitutes the present invention has the advantage that by virtue of the stepped separating surface it effects more intensive loosening of the layer of the material under treatment and at the same time possesses a higher rigidity.

Another advantage is that more intensive sifting of the material is achieved by virtue of shaping the screen steps in accordance with the invention. These features substantially increase the working capacity and longevity of the screen.

It is the greatest advantage of the screen constructed according to the invention that it provides for more thorough and intensive sifting of loose materials.

As compared with the screen known in the prior art, the use of the screen according to the invention in vibrating centrifugal separation machines, for example, for cleaning and/or grading seeds and various grain materials increases the working capacity of the machines involved by 25 to 30 percent without any substantial additional expenses.

What is claimed is:

1. In a vibrating centrifugal particle separation machine, a foraminated screen in the form of a solid of revolution having a stepped shape and exhibiting symmetry about the axis of revolution thereof, said screen being adapted for simultaneous rotational motion about said axis and reciprocating motion along said axis, said screen comprising a series of hollow truncated cones, each cone having an imperforate base at the larger diameter end thereof adjacent a material inlet of said machine, so that particle-containing material flows through the interior of said screen from the base toward the smaller diameter end of each cone thereof, a major surface portion of each cone having a multiplicity of screening holes therein, each imperforate base being adapted to be secured to a bearing component of said machine.

2. The screen according to claim 1, wherein all of said truncated cones have the same height and base diameter.

3. The screen of claim 1 wherein the steps of the screen have a height and a pitch wherein the height for each step is the same and the pitch for each step is the same.

* * * * *